US009435178B2

(12) United States Patent
Xu et al.

(10) Patent No.: US 9,435,178 B2
(45) Date of Patent: Sep. 6, 2016

(54) OIL AND GAS RESERVOIR ELECTRIC LOGGING OVERFLOW SAFETY CONTROL WIRELINE HANGER

(71) Applicant: KUERLE RIXIN MACHINERY MANUFACTURE CO., LTD., Kuerle (CN)

(72) Inventors: Huaiyuan Xu, Kuerle (CN); Feng Li, Kuerle (CN); Yuanliang Zhao, Kuerle (CN)

(73) Assignee: KUERLE RIXIN MACHINERY MANUFACTURE, CO., LTD., Xinjiang (CN)

( * ) Notice: Subject to any disclaimer, the term of this patent is extended or adjusted under 35 U.S.C. 154(b) by 282 days.

(21) Appl. No.: 14/147,427

(22) Filed: Jan. 3, 2014

(65) Prior Publication Data

US 2014/0116679 A1 May 1, 2014

Related U.S. Application Data

(63) Continuation of application No. PCT/CN2012/078322, filed on Jul. 7, 2012.

(30) Foreign Application Priority Data

Jul. 8, 2011 (CN) ..... 2011 2 0240395 U

(51) Int. Cl.
*E21B 33/072* (2006.01)
*E21B 41/00* (2006.01)
*E21B 34/06* (2006.01)

(52) U.S. Cl.
CPC ..... *E21B 41/0021* (2013.01); *E21B 33/072* (2013.01); *E21B 34/066* (2013.01)

(58) Field of Classification Search
CPC ..... E21B 33/0407; E21B 33/072
See application file for complete search history.

(56) References Cited

U.S. PATENT DOCUMENTS 2,815,969 A * 12/1957 Lebourg ..... D07B 7/12 277/322
3,952,377 A * 4/1976 Morell ..... E04C 5/122 24/136 R
2007/0044970 A1 3/2007 Streater, Jr. et al. ..... 166/301
2010/0206544 A1 8/2010 Dowling et al. ..... 166/75.11

FOREIGN PATENT DOCUMENTS

CN 2237897 Y 10/1996
CN 101158422 A 4/2008
CN 202109098 U 1/2012

OTHER PUBLICATIONS

Machine Translation of CN 2237897, original publication date Oct. 16, 1996.*
Yuanliang Zhao et al., "Study on Logging Safety under Condition of Narrow Mud Density Window" Well Logging Technology, vol. 34, No. 1, Feb. 2010, pp. 91-93.
International Search Report of corresponding International Application No. PCT/CN2012/078322, dated Jan. 10, 2013.

* cited by examiner

*Primary Examiner* — David Andrews
(74) *Attorney, Agent, or Firm* — J. C. Patents

(57) ABSTRACT

The present invention provides an oil and gas reservoir electronic logging overflow safety control wireline hanger which comprises a body (1) and a wireline clamping apparatus. Threads (5) are provided on a part of the outer surface of the upper end of the body (1). An entry opening (12) extending along a vertical direction is provided in the body (1) to receive the wireline. A tapering-down, truncated cone shaped passage (2) is provided inside the body (1). A detachable support apparatus (9) is fixed on the upper part of the body (1). The wireline clamping apparatus comprises two wedges (3), and each has a sector shaped cross-section and tapering-down truncated cone shape corresponding to the passage (2). The wedges are symmetrically fixed inside the passage (2) so that a wireline hole (4), with a diameter less than that of the wireline, is formed between the two wedges (3).

15 Claims, 3 Drawing Sheets

OIL AND GAS RESERVOIR ELECTRIC LOGGING OVERFLOW SAFETY CONTROL WIRELINE HANGER

CROSS-REFERENCE TO RELATED APPLICATIONS

This application is a continuation of International Application No. PCT/CN2012/078322, filed on Jul. 7, 2012, which claims priority to Chinese Patent Application No. 201120240395.4, filed on Jul. 8, 2011, both of which are hereby incorporated by reference in their entireties.

TECHNICAL FIELD

The present invention relates to a wireline hanger, and particularly to an oil and gas reservoir electronic logging overflow safety control wireline hanger.

BACKGROUND

During petroleum logging, in particular, oil and gas reservoir electric logging, the probability of overflow (a precursor of a blowout) is very high. An electric logging instrument is usually hanged by a wireline to be transported several kilometers in depth by a winch for underground tasks, and it is necessary to perform shut-in within a short period of time as overflow occurs. It will take much more time to lift up the electric logging instrument from several kilometers underground by the winch than the limited time for shut-in, and hence, in order to prevent a blowout incident, the wireline has to be cut off so that the electric logging instrument falls down. An operator would use a drilling tool to handle a blowout preventer in the well to realize shut-in. After the overflow problem is addressed, professional persons will try to salvage the electric logging instrument out of the well. As a result, the expensive electric logging instrument may suffer from loss or damage, posing great risk to electric logging projects.

SUMMARY

The present invention provides an oil and gas reservoir electronic logging overflow safety control wireline hanger, to overcome the deficiencies of the aforementioned prior art. It can effectively solve the problem that an electric logging instrument would fall down and suffer from loss or damage when overflow occurs, during well logging operations.

The technical solutions of the present invention are brought up by the following measures. An oil and gas reservoir electronic logging overflow safety control wireline hanger comprises a body and a wireline clamping apparatus; threads are provided on a part of the outer surface of the upper end of the body, an entry opening extending along a vertical direction is provided in the body to receive the wireline, a tapering-down, truncated cone shaped passage is provided inside the body, a detachable support apparatus is fixed on the upper part of the body, and the wireline clamping apparatus comprises two wedges, each has a sector shaped cross-section and tapering-down truncated cone shape which corresponds to the truncated cone shaped passage, the two wedges are symmetrically fixed inside the truncated cone shaped passage so that a wireline hole, with a diameter less than that of the wireline, is formed between the two wedges.

Further optimization or/and improvements for the technical solutions of the aforementioned invention are as follows.

Threads are provided on a part of an inner surface of the upper end of the aforementioned body to fix a wedge nut capable of pushing up the two wedges tightly, and a through-hole is provided in the wedge nut to communicate with the wireline hole.

Mounting holes are provided in the wedge nut, spaced apart from the through-hole.

The aforementioned detachable support apparatus may comprise at least two supporting rods, threads are provided at one end of each of the supporting rods, radial screw holes are provided in the body for receiving the supporting rods, and said ends of the supporting rods are fixed in the radial screw holes via the threads.

The inside of each aforementioned wedge is provided with thread grooves.

A straight passage is provided in the aforementioned body below the truncated cone shaped passage, the bottoms of the two wedges have truncated cone shape corresponding to the straight passage and are positioned inside the straight passage.

The present invention provides a convenient and compact structure which is user friendly. It can clamp the wireline hanger through the coordination between the wedges and the body, thus preventing the electric logging instrument from falling down to the bottomhole or suffer from loss or damage, meanwhile shut-in can be realized within scheduled time.

The numbers in figures are respectively: 1 body, 2 truncated cone shaped passage, 3 wedge, 4 wireline hole, 5 threads, 6 wedge nut, 7 through-hole, 8 mounting hole, 9 supporting rod, 10 radial screw hole, 11 straight passage, 12 wireline entry opening, 13 thread groove.

DESCRIPTION OF EMBODIMENTS

The present invention is not limited to the following embodiment, and it is possible to determine a specific embodiment in accordance with the technical solutions of the present invention and the actual condition.

Figure 1:
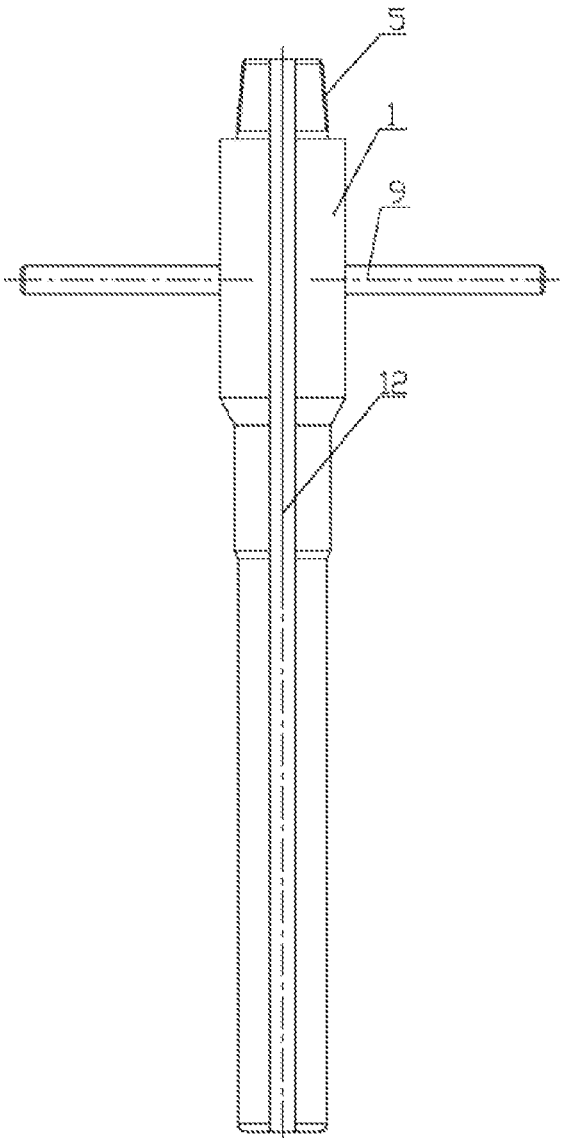
FIG. 1 is a view of the structure according to a preferred embodiment of the present invention.
Figure 2:
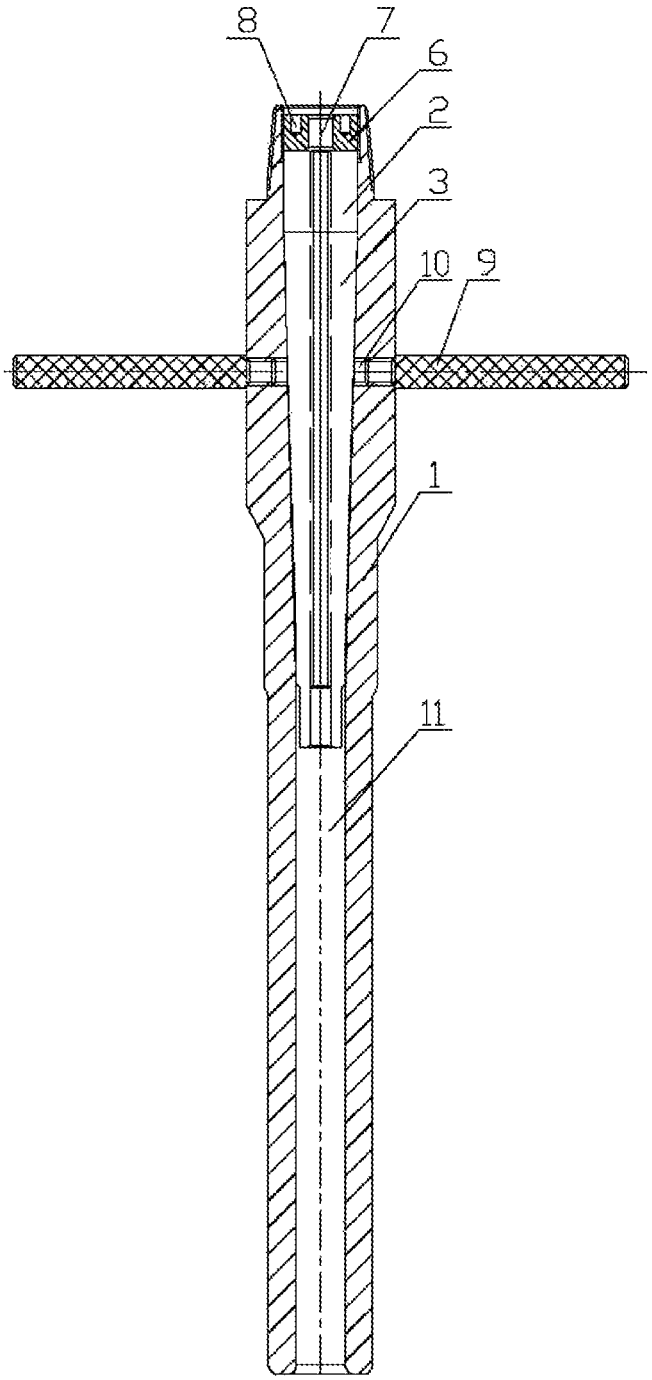
FIG. 2 is a cross section view of the structure according to a preferred embodiment of the present invention.
Figure 3:
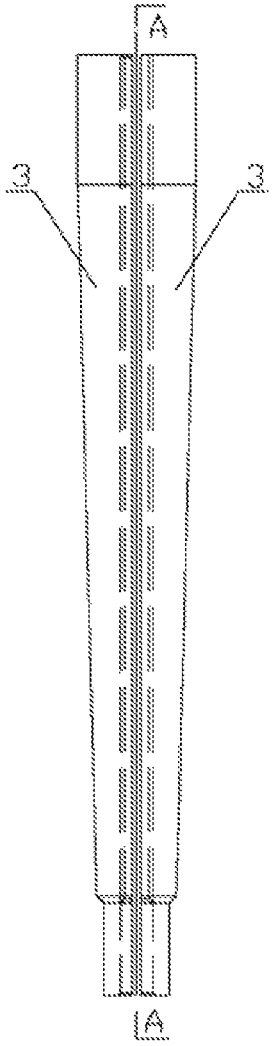
FIG. 3 is a view of the structure of two wedges according to a preferred embodiment of the present invention.
Figure 5:
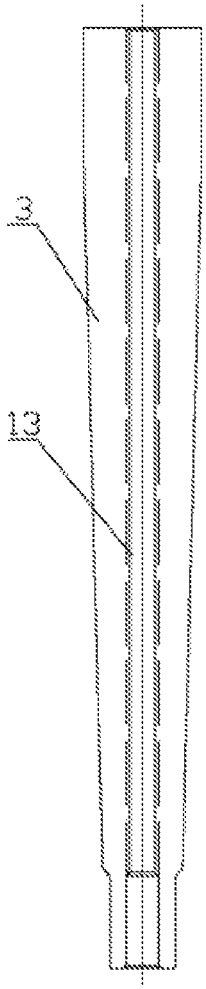
FIG. 5 is a cross section view along line A-A of the structure of FIG. 3.

In the present invention, for the convenience of description, the relative positional relationships of each part are all described in light of the layout pattern from FIG. 1 of the description, for example, the positional relationships of up, down, left, right, etc. are determined in light of the layout directions of the drawings of the description.

Further description in combination with an embodiment and figures regarding the present invention shall be provided as follows.

As shown in FIG. 1 to FIG. 5, the oil and gas reservoir electronic logging overflow safety control wireline hanger comprises a body 1 and a wireline clamping apparatus. Threads 5 are provided on a part of the outer surface of the upper end of the body 1. An entry opening 12 extending along a vertical direction is provided in the body 1 to receive the wireline. A tapering-down, truncated cone shaped passage 2 is provided inside the body 1. A detachable support apparatus is fixed on the upper part of the body 1. The wireline clamping apparatus comprises two wedges 3. Each of the wedges 3 has a sector shaped cross-section and tapering-down truncated cone shape which corresponds to that of the truncated cone shaped passage 2. The two wedges 3 are symmetrically fixed inside the truncated cone shaped passage 2 so that a wireline hole 4, with a diameter less than that of the wireline, is formed between the two wedges 3.

It is possible to further optimize or/and improve the aforementioned oil and gas reservoir electronic logging overflow safety control wireline hanger in accordance with actual demand.

As shown in FIG. 1 to FIG. 5, threads are also provided on a part of an inner surface of the upper end of the body 1 to fix a wedge nut 6 capable of pushing up the two wedges 3 tightly. A through-hole 7 is provided in the wedge nut 6 to communicate with the wireline hole 4. Thus, the wedges 3 can be prevented from being pushed out and hence the wireline can still be locked, when the overflow pressure become extremely high.

As shown in FIG. 1 to FIG. 5, mounting holes 8 are provided in the wedge nut 6, spaced apart from the through-hole 7. A special tool can be placed inside the mounting holes 8 to fix the wedge nut 6 in the upper end of the body 1 via the threads.

As shown in FIG. 1 to FIG. 5, the detachable support apparatus comprises at least two supporting rods 9. Threads are provided at one end, i.e. the inner end, of each of the supporting rods 9. Radial screw holes 10 are provided in the body 1, for receiving the supporting rods. The inner ends of the supporting rods 9 are fixed in the radial screws holes 10 via the threads. The body 1 may be supported by the supporting rods 9 on a suspender at the entrance of the well.

Figure 4:
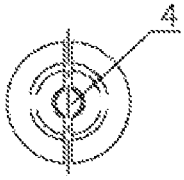
FIG. 4 is a top view of the structure of FIG. 3.

As shown in FIG. 4, the inside of each wedge 3 is provided with thread grooves 13 to increase the friction between the wireline hole 4 and the wireline, thus better tightening the wireline.

As shown in FIG. 1 to FIG. 5, a straight passage 11 is provided in the body 1 below the truncated cone shaped passage 2. The bottoms of the two wedges 3 have truncated cone shape corresponding to the straight passage 11 and are positioned inside the straight passage 11 to centralize the wireline.

The aforementioned technical features constitute a preferred embodiment of the present invention, and have a stronger adaptability and best effect. It is possible to increase or reduce unnecessary technical features in light of actual demand, so as to satisfy needs for different situations.

The operating process of the preferred embodiment of the present invention is as follows. At the beginning of the well logging, an electric logging instrument is hanged by a wireline to be transported into the deep by a winch for underground tasks. When overflow occurs in the well, the wireline is moved from the wireline entry opening 12 of the body 1 into the truncated cone shaped passage 2 and the straight passage 11 of the body 1, meanwhile, the body 1 is supported on a suspender at the entrance of the well by the supporting rods 9. The two wedges 3 are inserted into the truncated cone shaped passage 2 and the straight passage 11 of the body 1 from above. The electric logging wireline is embedded into the wireline hole 4 with threads between two wedges 3, meanwhile free the wireline. Under the gravity of the electric logging wireline, the electric logging wireline is locked by the wedges 3 through the coordination between the outer conical surface of the wedges 3 and the inner conical surface of the body 1. Then the wedge nut 6 is screwed into the body 1 through the threads to press against the wedges 3, preventing that the wireline is no longer locked due to the overflow pressure which would push out the wedges 3. Subsequently, the electric logging wireline is cut off by a hydraulic tong. The electric logging wireline is locked in the body 1 by the two wedges 3 to hang the electric logging instrument. Consequently, an operator may connect a drill adapter to a standard drill connector of the body 1. The adaptor may be connected to a bypass valve or a drilling tool upward, according to downhole operation specification, which can be transported by a hook into the well to operate a blowout preventer to quickly shut in, preventing the occurrence of a blowout incident. Meanwhile, the electric logging instrument is hanged by the electric logging wireline according the present invention. After handling the overflow, according to the present invention, the electric logging instrument is drawn out of the well by the electric logging wireline, while the drilling tool is lifted out of the wellhead. As a result, fall and loss of the electric logging instrument can be prevented and avoided.

What is claimed is:

1. An oil and gas reservoir electronic logging overflow safety control wireline hanger, comprising a body and a wireline clamping apparatus, wherein threads are provided on a part of an outer surface of an upper end of the body, the body is provided with a tapering-down truncated cone shaped passage and a wireline entry opening extending along a vertical direction to receive a wireline, a detachable support apparatus is fixed to the upper end of the body, and the wireline clamping apparatus comprises two wedges each of which has a sector shaped cross-section and a tapering-down truncated cone shape corresponding to the truncated cone shaped passage, and wherein the two wedges are symmetrically fixed inside the truncated cone shaped passage so that a wireline hole is formed between the two wedges, when the two wedges are fully pressed together, a diameter of the wireline hole is less than that of the wireline received between the two wedges;

wherein threads are provided on a part of an inner surface of the upper end of the body to fix a wedge nut capable of pushing up the two wedges tightly and the wedge nut is provided with a through-hole to communicate with the wireline hole.

2. The oil and gas reservoir electronic logging overflow safety control wireline hanger according to claim 1, wherein the wedge nut is also provided with a mounting hole spaced apart from the through-hole.

3. The oil and gas reservoir electronic logging overflow safety control wireline hanger according to claim 2, wherein the detachable support apparatus comprises at least two supporting rods, and the supporting rods are fixed in radial screw holes provided in the body via threads provided at one end of each of the supporting rods.

4. The oil and gas reservoir electronic logging overflow safety control wireline hanger according to claim 2, wherein an inside of each wedge is provided with a thread groove.

5. The oil and gas reservoir electronic logging overflow safety control wireline hanger according to claim 2, wherein a straight passage is provided in the body below the truncated cone shaped passage, and bottoms of the two wedges have a truncated cone shape corresponding to the straight passage and are positioned inside the straight passage.

6. The oil and gas reservoir electronic logging overflow safety control wireline hanger according to claim 1, wherein the detachable support apparatus comprises at least two supporting rods, and the supporting rods are fixed in radial screw holes provided in the body via threads provided at one end of each of the supporting rods.

7. The oil and gas reservoir electronic logging overflow safety control wireline hanger according to claim 6, wherein an inside of each wedge is provided with a thread groove.

8. The oil and gas reservoir electronic logging overflow safety control wireline hanger according to claim 7, wherein a straight passage is provided in the main body below the truncated the cone shaped passage, and bottoms of the two wedges have a truncated cone shape corresponding to the straight passage and are positioned inside the straight passage.

9. The oil and gas reservoir electronic logging overflow safety control wireline hanger according to claim 6, wherein a straight passage is provided in the body below the truncated cone shaped passage, and bottoms of the two wedges have a truncated cone shape corresponding to the straight passage and are positioned inside the straight passage.

10. The oil and gas reservoir electronic logging overflow safety control wireline hanger according to claim 1, wherein an inside of each wedge is provided with a thread groove.

11. The oil and gas reservoir electronic logging overflow safety control wireline hanger according to claim 10, wherein a straight passage is provided in the body below the truncated cone shaped passage, and bottoms of the two wedges have a truncated cone shape corresponding to the straight passage and are positioned inside the straight passage.

12. The oil and gas reservoir electronic logging overflow safety control wireline hanger according to claim 1, wherein a straight passage is provided in the body below the truncated cone shaped passage, and bottoms of the two wedges have a truncated cone shape corresponding to the straight passage and are positioned inside the straight passage.

13. An oil and gas reservoir electronic logging overflow safety control wireline hanger, comprising a body and a wireline clamping apparatus, wherein threads are provided on a part of an outer surface of an upper end of the body, the body is provided with a tapering-down truncated cone shaped passage and a wireline entry opening extending along a vertical direction to receive a wireline, a detachable support apparatus is fixed to the upper end of the body, and the wireline clamping apparatus comprises two wedges each of which has a sector shaped cross-section and a tapering-down truncated cone shape corresponding to the truncated cone shaped passage, and wherein the two wedges are symmetrically fixed inside the truncated cone shaped passage so that a wireline hole is formed between the two wedges, when the two wedges are fully pressed together, a diameter of the wireline hole is less than that of the wireline received between the two wedges;

wherein a straight passage is provided in the body below the truncated cone shaped passage, and bottoms of the two wedges have a truncated cone shape corresponding to the straight passage and are positioned inside the straight passage.

14. The oil and gas reservoir electronic logging overflow safety control wireline hanger according to claim 13, wherein an inside of each wedge is provided with a thread groove.

15. An oil and gas reservoir electronic logging overflow safety control wireline hanger, comprising a body and a wireline clamping apparatus, wherein threads are provided on a part of an outer surface of an upper end of the body, the body is provided with a tapering-down truncated cone shaped passage and a wireline entry opening extending along a vertical direction to receive a wireline, a detachable support apparatus is fixed to the upper end of the body, and the wireline clamping apparatus comprises two wedges each of which has a sector shaped cross-section and a tapering-down truncated cone shape corresponding to the truncated cone shaped passage, and wherein the two wedges are symmetrically fixed inside the truncated cone shaped passage so that a wireline hole is formed between the two wedges, when the two wedges are fully pressed together, a diameter of the wireline hole is less than that of the wireline received between the two wedges;

wherein the detachable support apparatus comprises at least two supporting rods, and the supporting rods are fixed in radial screw holes provided in the body via threads provided at one end of each of the supporting rods;

wherein a straight passage is provided in the body below the truncated cone shaped passage, and bottoms of the two wedges have a truncated cone shape corresponding to the straight passage and are positioned inside the straight passage.

* * * * *